United States Patent [19]

Buschmann

[11] 4,276,979

[45] Jul. 7, 1981

[54] SLAB COOLING AND CONVEYING APPARATUS

[75] Inventor: Horst Buschmann, Solingen-Ohligs, Fed. Rep. of Germany

[73] Assignee: Schloemann-Siemag Aktiengesellschaft, Dusseldorf, Fed. Rep. of Germany

[21] Appl. No.: 6,173

[22] Filed: Jan. 24, 1979

[30] Foreign Application Priority Data

Jan. 28, 1978 [DE] Fed. Rep. of Germany ..... 2803705

[51] Int. Cl.[3] ..... B65G 25/00

[52] U.S. Cl. ..... 198/775; 198/409; 198/489; 414/680

[58] Field of Search ..... 198/774–776, 198/412, 413, 409, 489, 490; 414/680, 684, 106, 107, 774, 779

[56] References Cited

U.S. PATENT DOCUMENTS

| | | | |
|---|---|---|---|
| 1,931,405 | 10/1933 | Dahlstrom | 198/774 X |
| 1,965,868 | 7/1934 | Vickers | 198/774 |
| 2,851,177 | 9/1958 | Meller | 198/489 |
| 3,221,870 | 12/1965 | Pagay | 198/774 |
| 3,679,076 | 7/1972 | Miller et al. | 414/107 |
| 3,736,997 | 6/1973 | Bottorf | 198/776 |

*Primary Examiner*—Robert B. Reeves
*Assistant Examiner*—Douglas D. Watts
*Attorney, Agent, or Firm*—Holman & Stern

[57] ABSTRACT

Metal slabs are cooled on a bed across which they are conveyed in a stepwise manner. The slabs are received on a number of first beams which move along a closed path having components in both a vertical and a horizontal direction. For part of the movement path of the first beams, the slabs are supported on second beams. The beams are themselves supported from below by pressure medium cylinders and have shoulders for supporting the slabs on edge. The stroke of the cylinders, producing the vertical movement of the firstbeam must be greater than the height of the shoulders.

7 Claims, 3 Drawing Figures

SLAB COOLING AND CONVEYING APPARATUS

BRIEF SUMMARY OF THE INVENTION

The invention relates to slab cooling and conveying apparatus, wherein the slabs are received in an on edge position on vertically displaceable beams and are conveyed in steps transversely to their longitudinal axis by means of conveyor beams which are displaceable in a horizontal direction.

For the purpose of cooling slabs, cooling beds are known wherein the slabs in a flat position are conveyed thereover in a stepwise manner. Also cooling apparatuses are already known on which the slabs are cooled while in an on edge position between vertical support rods. These have a smaller space requirement than flat cooling beds.

In a known cooling apparatus, stationary beams and beams suspended from a support frame for swinging movement in and against the conveyance direction are arranged in a container filled with cooling water. The beams are provided with support rods between which the slabs are received in an on edge position. The stationary beams and the swinging beams are pivotally mounted on shafts. The support rods attached to the beams may be lowered by the pivotal movement about the shafts below the conveyance plane of the slabs. The course of movement of the apparatus is controlled in such a manner that during the feed stroke of the swinging beams the support rods thereof are erected and the support rods of the stationary beams are lowered. During the return stroke of the swinging beams the support rods thereof are lowered, whereas the rods of the stationary beams are in the erect position and support the slabs.

It is a disadvantage of this apparatus that edges of the slabs may be damaged by the swing movement of the beams. The shafts of the beams can be mounted only at their free ends and are subjected to a bending load by the weight of the slabs. Thereby the number of slabs which can be received, i.e. the length of the cooling bed, is limited. A further disadvantage resides in that the bearings of the displaceable beams lie with a high inherent weight on the support frame which extends parallel to the longitudinal axis of the slabs, and which is suspended from swing arms at the front end and is likewise subjected to a bending load by the entire weight of the slabs. Thereby likewise constructional limits are set for the slab length, i.e. the width of the cooling bed.

The main object of the invention is to provide a slab cooling apparatus by means of which any desired number of slabs of any desired length and any desired weight can be cooled in air without damage to the edges in a small space and with low power demand by means of simple constructional elements.

According to the invention, there is provided slab cooling and conveying apparatus comprising a plurality of conveyor beams arranged side-by-side and formed with shoulders for receiving slabs in an "on-edge" position, pressure medium cylinders supporting said beams from below and adapted to move them in a vertical plane, displacement means for displacing the beams back and forth, and slab support means for supporting the slabs when the displacement means displaces the conveyor beams in a direction opposite to a conveying direction, the pressure medium cylinders being pivotally connected to the beams so that the beams can be moved simultaneously by the pressure medium cylinders and the displacement means, the stroke of the pressure medium cylinders being greater than the height of said shoulders.

In this way a simpler and more easily observable slab cooling apparatus is provided. Since each beam is supported individually, and, if necessary, at points along its length, the length of the beams may be selected as desired, and thus any desired number of slabs may be accommodated. Moreover, since any desired number of beams may be arranged parallel to each other, the apparatus of the invention can be used even for extremely long slabs.

According to a further feature of the invention, each beam is received between vertical guide faces. Therefore connecting support members between the individual beams are unnecessary. This leads to a reduction of the total height and weight of the apparatus and thus to a saving of driving power. Each pair of beams together with the associated cylinders and guide frames forms a unit which is the basis for a financially economical modular manner of construction. Furthermore it is advantageous that the cylinders can be operated at a pressure which corresponds to the weight of the beams. The oil pressure need not be increased until the beams support the slabs.

The beams may be retainable in the raised position by means of abutments which are displaceable into the path of the beams. Thereby unintentional downward movement of the beams upon a failure of the hydraulic system is avoided.

In a further embodiment of the invention the slab cooling apparatus is preceded by erector levers and is followed by delivery levers which are pivotal between a horizontal position and a vertical position. In this way the slabs can be raised and lowered without damaging them.

The erector levers may be constructed with a support member provided with a retaining edge pivotally connected to an arm which is mounted on a horizontal shaft and which is pivotal by means of pressure medium cylinders; the support member may be swung forward out of the range of the arm by means of an auxiliary cylinder. Immediately after the slab has been disposited on the beams, the support members can be withdrawn and subsequently the erector levers are swung back into the horizontal position. Moreover, owing to the withdrawal of the support members, a slab arriving on a supply roller way does not abut against the retaining edges.

The slabs are prevented from tipping out of the erector levers by an arrangement wherein considered in the direction of upward swinging movement, the centre of gravity of all slab cross-sections conveyed lies, throughout the entire pivot range of the arms, behind the vertical line through the free apex of the retaining edge.

Further features and advantages of the present invention will become apparent from the following description of a preferred embodiment which is given by way of example and is to be read in conjunction with the accompanying drawings.

DETAILED DESCRIPTION

Figure 1:
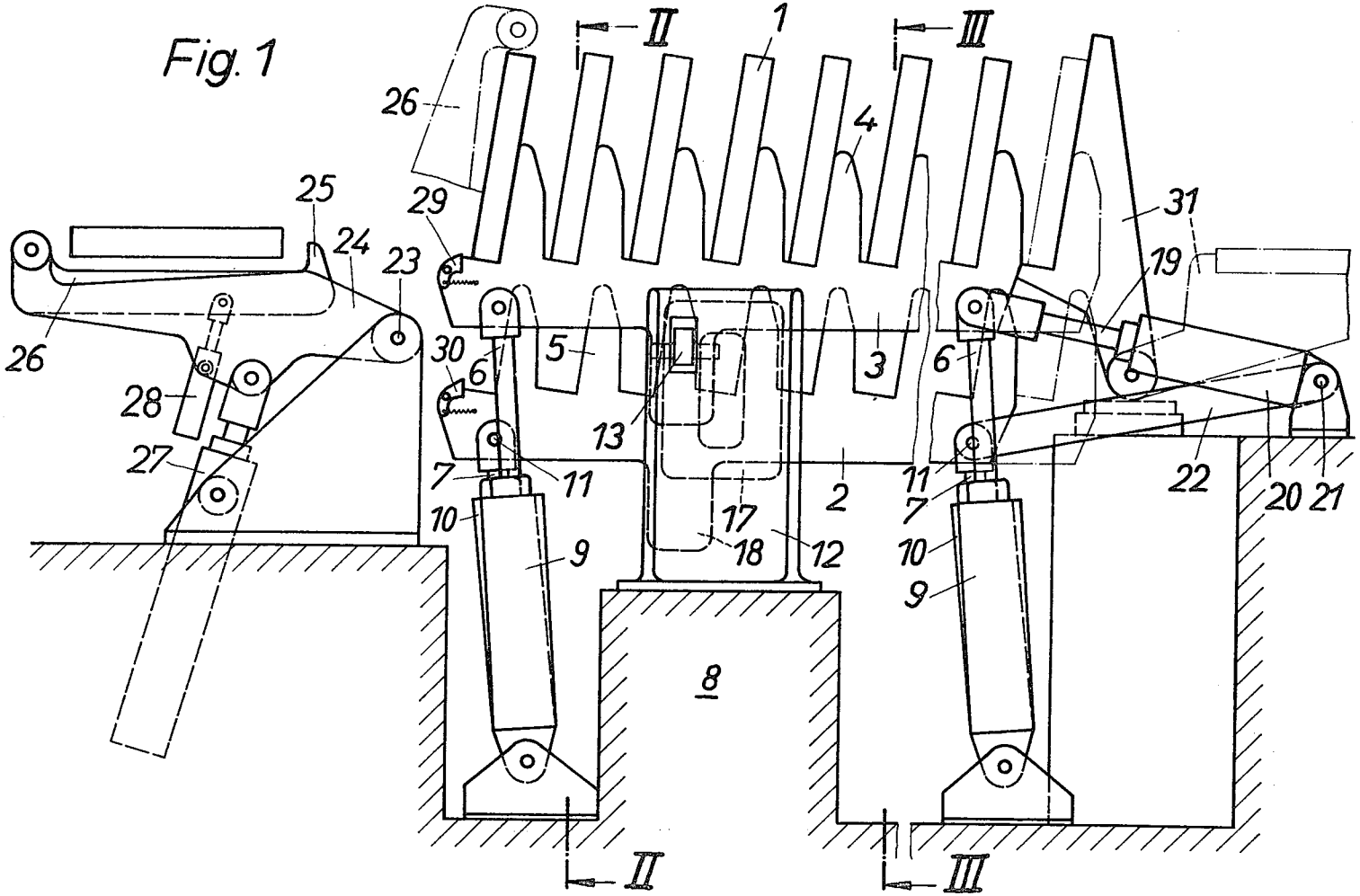
FIG. 1 is a side view of a slab cooling apparatus according to the invention.
Figure 2:
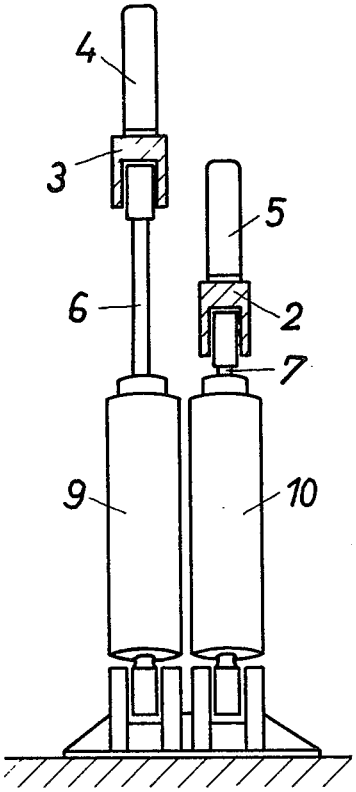
FIG. 2 is a section on the line II—II in FIG. 1.
Figure 3:
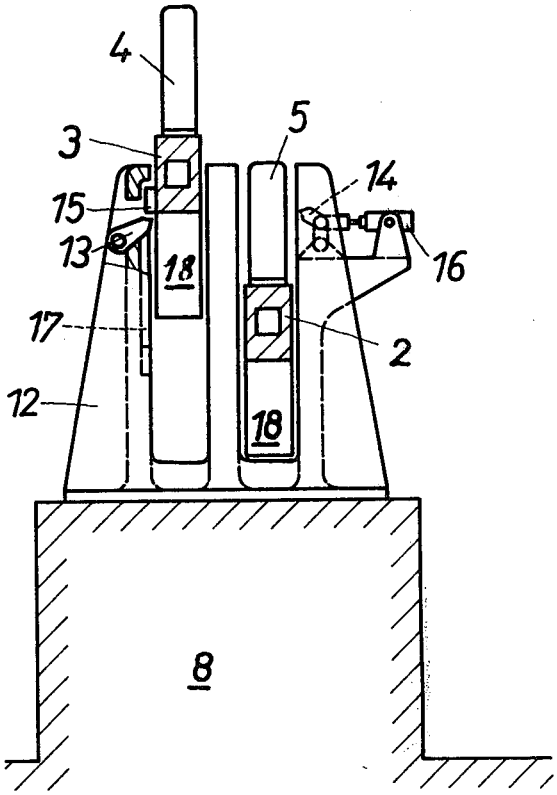
FIG. 3 is a section on the line III—III in FIG. 1.

A cooling apparatus for slabs 1 is formed by at least two vertical displaceable support beams 2 and at least two conveyor beams 3 which are displaceable horizontally and vertically along closed curves. The support beams 2 and the conveyor beams 3 are provided with a plurality of support shoulders 4, 5 in an upright position for the purpose of receiving the slabs 1 in an on-edge position as shown in FIG. 1.

For supporting and guiding the support beams 2 and the conveyor beams 3, pressure medium cylinders 9, 10 are provided on a base structure 8. The cylinders 9, 10 are arranged to be pivotal in the conveyance direction of the slabs 1, and their piston rods 6, 7 are connected to the underside of the beams 2, 3 by means of pivot pins 11. As an additional guidance of the beams 2, 3, guide frames 12 are anchored on the base structure 8, and the beams 2, 3 are displaceably accommodated between vertical guide faces thereof.

Retaining pawls 13, 14 are mounted near the top of the guide frame 12. The pawls are able to support the beams 2, 3 in the raised position. When such support is required, the pawl 14, actuated by an auxiliary cylinder 16 directly engages the beams 2 from below, whereas an abutment 15 on the beam 3 is associated with the pawl 13. Since the pawl 13 is travelled over by the abutment 15 only from below and the downward movement occurs in a different region because of the horizontal stroke, an actuator cylinder for the pawl 13 is superfluous. On the side of the abutments 15, the guide face of the guide frame 12 is provided with a recess 17 which extends rectangularly in correspondence with the location cam of the abutment 15.

The beams 2, 3 each have a guide nose 18 extending from their lower edge in order that guiding contact with the guide frame 12 is not lost when the beams are raised.

For the horizontal movement of the conveyor beams 3, the front ends thereof have pivotally connected thereto piston rods 19 of cylinders 20 which are arranged in the conveyance direction, the cylinders 20 being pivotally mounted on a horizontal shaft 21. At the front end the support beams 2 are pivotally connected to a guide rod 22 which is pivotally mounted on the shaft 21, and are guided thereby approximately vertically. If all the beams are to operate as conveyor beams, further pressure medium cylinders can be provided in place of the guide rods 22. This alternative is not illustrated.

For the purpose of transferring the slabs 1 from a supply roller way to the upright position on the beams 2, 3, an erection device is arranged in front of the beams. This consists of at least two arms 24 which are pivotal on a horizontal shaft 23 and the free ends of which have a support member 26 pivotally connected thereto provided with a retaining edge 25. Each arm 24 is pivotal between a horizontal receiving position and a vertical transfer position by means of a cylinder 27 mounted on the base structure. An auxiliary cylinder 28 attached to the arm 24 serves for retracting the support member 26 when the arms 24 are in the vertical transfer position.

Slabs arriving from a rolling mill or a continuous casting installation are conveyed onto the arms 24 of the erecting device on a supply roller way not illustrated. The slabs are placed on-edge in front of the first support shoulder 4 of the conveyor beams 3 by swinging the arms 24 upwards. Thereafter the support member 26 is retracted to deposit the slab on the shoulder 4 and the arms 24 are swung back to the horizontal position.

Holder pawls 29, 30 loaded by gravity or spring force are arranged at the front edge of the beams 2, 3 and prevent the slabs 1 from sliding off.

When the support beams 2 are lowered, the conveyor beams 3, which are in their uppermost positions, are displaced a predetermined distance in the conveyance direction by actuation of the cylinders 20. The predetermined distance is equal to the distance between supports 5 on the support beams. Thereupon the support beams 2 are raised to their uppermost positions by actuation of the lifter cylinders 10 and the conveyor beams 3 are lowered by relieving the lifter cylinders 9. The support beams 2 then pick up the slabs 1 from the conveyor beams 3 when all the beams are fully raised. The conveyor beams are moved to their forward lower starting position by actuation of the cylinders 20. The apparatus is rendered ready for receiving a new slab by renewed raising of the conveyor beams 3 and lowering of the support beams 2. In this manner the slabs 1 travel over the length of the beams 2, 3 and cool down. At the end of the beams 2, 3 the slabs 1 are received by pivotally mounted delivery levers 31 and are swung to the horizontal position and deposited on a delivery roller way or a storage grating, neither of which are illustrated.

I claim:

1. Slab cooling and conveying apparatus comprising a plurality of conveyor beams arranged parallel and each formed with a uniformly spaced longitudinal succession of upwardly projecting shoulders each with an inclined support face for receiving slabs extending across said beams and supporting them in an "on edge" position, whereby cooling is facilitated;

pressure-medium cylinders supporting said conveyor beams from below and adapted to move said beams up and down;

displacement means for displacing said beams back and forth by an amount equivalent to said longitudinal spacing of said shoulders, said conveyor beams being moved vertically and horizontally by said pressure-medium cylinders and said displacement means, respectively;

a plurality of elongate and parallel support beams each provided with a like succession of said shoulders for supporting said slabs, laid across them, while said displacement means displaces the conveyor beams in the direction opposite to a conveying direction;

pressure-medium cylinders supporting said support beams from below and adapted to move said support beams up and down, the stroke of the pressure-medium cylinders in both sets of beams being greater than the projection of said shoulders;

guide rods pivotally connected at one end to said support beams and pivotally connected at the other end to a fixed member to guide said support beam for vertical movement only;

the conveyor beam pressure-medium cylinders being pivotally connected to the conveyor beams so that the conveyor beams can be moved by the displacement means while supported by the conveyor beam pressure-medium cylinders.

2. The apparatus of claim 1, including vertical guide faces for said up and down movement between which each beam is received.

3. The apparatus of claim 1, including abutments which can be moved into a position where they retain the conveyor and support beams respectively in the raised position.

4. The apparatus of claim 1, including erector levers upstream and delivery levers downstream of the conveyor beams, and means for pivoting said levers between horizontal and approximately vertical positions.

5. The apparatus of claim 4, wherein the erector levers comprise a horizontal shaft, an arm pivotally mounted on the shaft, a support member pivotally mounted on the arm, said support member including a slab retaining edge, a pressure medium cylinder for pivoting the arm about the shaft, and an auxiliary cylinder for pivoting the support member relative to the arm whereby the retaining edge no longer projects from the arm.

6. Slab cooling and conveying apparatus comprising a plurality of conveyor beams arranged parallel and each formed with a uniformly spaced longitudinal succession of upwardly projecting shoulders each with an inclined support face for receiving slabs extending across said beams and supporting them in an "on edge" position, whereby cooling is facilitated;

pressure-medium cylinders supporting said conveyor beams from below and adapted to move said beams up and down;

displacement means for displacing said beams back and forth by an amount equivalent to said longitudinal spacing of said shoulders;

a plurality of elongate and parallel support beams each provided with a like succession of said shoulders for supporting said slabs, laid across them, while said displacement means displaces the conveyor beams in the direction opposite to a conveying direction;

pressure-medium cylinders supporting said support beams from below and adapted to move said support beams up and down, the stroke of the pressure-medium cylinders in both sets of beams being greater than the projection of said shoulders;

the conveyor beam pressure-medium cylinders being pivotally connected to the conveyor beams so that the conveyor beams can be moved by the displacement means while supported by the conveyor beam pressure-medium cylinders;

erector levers upstream and delivery levers downstream of the conveyor beams, and means for pivoting said levers between horizontal and approximately vertical positions;

said erector levers comprising a horizontal shaft, an arm pivotally mounted on the shaft, a support member pivotally mounted on the arm, said support member including a slab retaining edge;

said means for pivoting said erector levers comprising a pressure-medium cylinder for pivoting the arm about the shaft, and an auxiliary cylinder for pivoting the support member relative to the arm whereby the retaining edge no longer projects from the arm;

said support member having a recess which is bounded by said retaining edge, so that the center of gravity of the largest slab cross-section which can be handled by the apparatus lies in the recess behind a line connecting the pivot axis of the support arm and the tip of the retaining edge.

7. Slab cooling and conveying apparatus comprising a plurality of conveyor beams arranged parallel and each formed with a uniformly spaced longitudinal succession of upwardly projecting shoulders each with an inclined support face for receiving slabs extending across said beams and supporting them in an "on edge" position, whereby cooling is facilitated;

pressure-medium cylinders for each conveyor beam supporting said conveyor beams from below and adapted to move said beams up and down, the totality of such being arranged for common operation;

a pressure-medium cylinder for each conveyor beam for displacing said beams back and forth by an amount equivalent to said longitudinal spacing of said shoulders, the totality of such being arranged for common operation;

a plurality of elongate and parallel support beams each provided with a like succession of said shoulders for supporting said slabs, laid across them, while said displacement means displaces the conveyor beams in the direction opposite to a conveying direction;

pressure-medium cylinders for each support beam supporting said support beams from below and adapted to move said support beams up and down, the totality of such being arranged for common operation respectively in the raised position, the stroke of the pressure-medium cylinders in both sets of beams being greater than the projection of said shoulders;

the conveyor beam pressure-medium cylinders being pivotally connected to the conveyor beams so that the conveyor beams can be moved by the displacement means while supported by the conveyor beam pressure-medium cylinders.

* * * * *